US011051118B2

(12) United States Patent
Uchida et al.

(10) Patent No.: US 11,051,118 B2
(45) Date of Patent: Jun. 29, 2021

(54) SOUND PICKUP DEVICE AND SOUND PICKUP METHOD

(71) Applicant: JVCKENWOOD Corporation, Yokohama (JP)

(72) Inventors: Hiroshi Uchida, Yokohama (JP); Hisako Murata, Yokohama (JP); Takahiro Gejo, Yokohama (JP); Yumi Fujii, Yokohama (JP); Kuniaki Takachi, Yokohama (JP); Masaya Konishi, Yokohama (JP); Takayuki Uchida, Yokohama (JP); Satoshi Yoshimura, Yokohama (JP); Shuji Tanifuji, Yokohama (JP)

(73) Assignee: JVCKENWOOD Corporation, Yokohama (JP)

( * ) Notice: Subject to any disclaimer, the term of this patent is extended or adjusted under 35 U.S.C. 154(b) by 0 days.

(21) Appl. No.: 16/538,601

(22) Filed: Aug. 12, 2019

(65) Prior Publication Data

US 2019/0373385 A1 Dec. 5, 2019

Related U.S. Application Data

(63) Continuation of application No. PCT/JP2018/000381, filed on Jan. 10, 2018.

(30) Foreign Application Priority Data

Feb. 15, 2017 (JP) ..... JP2017-026332

(51) Int. Cl.
*H04R 29/00* (2006.01)
*H04R 1/08* (2006.01)

(52) U.S. Cl.
CPC ..... *H04R 29/004* (2013.01); *H04R 1/083* (2013.01)

(58) Field of Classification Search
CPC ..... H04R 29/001; H04R 1/083
See application file for complete search history.

(56) References Cited

U.S. PATENT DOCUMENTS

2003/0125067 A1 7/2003 Takeda et al.
2009/0022343 A1* 1/2009 Van Schaack ..... H04R 1/028 381/309

(Continued)

FOREIGN PATENT DOCUMENTS

CN 103916806 * 7/2014
DE 19645307 A1 5/1998

(Continued)

OTHER PUBLICATIONS

"Binaural Microphone with TEDS Type 4101-A", Product Data, Bruel & Kjaer, Total 4 pages (2013).

(Continued)

*Primary Examiner* — Regina N Holder
(74) *Attorney, Agent, or Firm* — Procopio, Cory, Hargreaves & Savitch LLP

(57) ABSTRACT

A sound pickup device according to this embodiment includes a microphone part placed at a sound pickup position in close proximity to an ear hole without blocking an ear canal, and positioned so as to face outside of the ear canal, and a wire having flexibility and extending to the sound pickup position. Further, in this embodiment, at least part of the wire is formed along an auricle.

7 Claims, 17 Drawing Sheets

(56) References Cited

U.S. PATENT DOCUMENTS

| | | | | |
|---|---|---|---|---|
| 2009/0110223 | A1 | 4/2009 | Semcken | |
| 2009/0208027 | A1 | 8/2009 | Fukuda et al. | |
| 2010/0092016 | A1 | 4/2010 | Iwano et al. | |
| 2011/0255725 | A1* | 10/2011 | Faltys | H04R 25/407 381/328 |
| 2013/0051593 | A1 | 2/2013 | Semcken | |
| 2013/0051594 | A1 | 2/2013 | Semcken | |
| 2014/0056453 | A1* | 2/2014 | Olsen | H04R 25/652 381/328 |
| 2018/0235540 | A1* | 8/2018 | Kirszenblat | A61B 5/6817 |

FOREIGN PATENT DOCUMENTS

| | | | | |
|---|---|---|---|---|
| EP | 1931170 | A2 | 6/2008 | |
| JP | H05-252598 | A | 9/1993 | |
| JP | H10-056698 | A | 2/1998 | |
| JP | 2003-258719 | A | 9/2003 | |
| JP | 2013-258719 | A | 12/2013 | |
| WO | 2006/026812 | A2 | 3/2006 | |
| WO | WO-2009101142 | A1 * | 8/2009 | H04R 25/656 |
| WO | WO2010131360 | * | 11/2010 | |
| WO | 2016/041950 | A1 | 3/2016 | |

OTHER PUBLICATIONS

Sattoh, T. "Basic characteristics of special microphone and dammy head", Noise control, vol. 28, No. 2 (2004), pp. 85-92.

Notice of Reasons for Refusal for related Japanese Patent Application No. 2017-026332, dated Oct. 6, 2020; Engish translation provided (8 page).

Iwanami Physicochemistry Dictionary, Japan, Iwanami Shoten, Inc., 4th Edition 11th Printing, pp. 723-724 issued on Oct. 18, 1996.

Satoh, T. "Basic characteristics of special microphone and dammy head", Noise control, vol. 28, No. 2 (2004), pp. 85-92.

* cited by examiner

10A

10D

10D

SOUND PICKUP DEVICE AND SOUND PICKUP METHOD

CROSS REFERENCE TO RELATED APPLICATION

This application is based upon and claims the benefit of priority from Japanese patent application No. 2017-26332 filed on Feb. 15, 2017, and is a Continuation of International application No. PCT/JP2018/000381 filed on Jan. 10, 2018, the disclosure of which are incorporated herein in its entirety by reference.

BACKGROUND

The present invention relates to a sound pickup device and a sound pickup method.

Patent Literature 1 (Japanese Unexamined Patent Application Publication No. H10-56698) discloses an electric-acoustic conversion device including an ear-applied part and an ear-hook part. The ear-applied part has a speaker and is placed in the hollow of the auricle. The ear-hook part supports the ear-applied part and is hooked on the rim of the auricle. The ear-applied part is extensible and length-adjustable and is also rotatable and angle-adjustable with respect to the ear-hook part.

Sound localization techniques include an out-of-head localization technique, which localizes sound images outside the head of a listener by using binaural headphones (Patent Literature 2). Patent Literature 2 (Japanese Unexamined Patent Application Publication No. H5-252598) uses a sound localization filter generated from a result of convolving an inverse headphone response and a spatial response. The spatial response is obtained by measurement of spatial transfer characteristics from a sound source (speaker) to the ears (head-related transfer function HRTF). The inverse headphone response is an inverse filter that cancels out characteristics from headphones to the ears or eardrums (ear canal transfer function ECTF; which are also called ear canal transfer characteristics).

SUMMARY

An inverse headphone response (inverse filter) is generated based on a result of measuring the ear canal transfer characteristics, which are used in such an out-of-head localization technique. Thus, it is necessary to perform measurement by placing a microphone near the ear or eardrum with headphones worn. A sound pickup device that places a microphone at an appropriate sound pickup position while headphones are worn is not disclosed.

A sound pickup device according to this embodiment includes a microphone part configured to be placed at a sound pickup position in close proximity to an ear hole without blocking an ear canal, and positioned so as to face outside of the ear canal, and a wire having flexibility and configured to extend to the sound pickup position, wherein at least part of the wire is formed along an auricle.

A sound pickup device according to this embodiment includes a first sound pickup unit configured to be worn on a left ear of a user, a second sound pickup unit configured to be worn on a right ear of the user, and a connection part configured to connect the first sound pickup unit and the second sound pickup unit, and generate an urging force in a direction where the first sound pickup unit and the second sound pickup unit come close to each other, wherein each of the first and second sound pickup units includes a microphone part configured to be placed at a sound pickup position in close proximity to an ear hole without blocking an ear canal, and positioned so as to face outside of the ear canal, and a wire having flexibility and configured to extend to the sound pickup position.

DETAILED DESCRIPTION

A sound pickup device according to this embodiment performs measurement for generating a filter to be used in out-of-head localization. The overview of out-of-head localization is described hereinafter. The out-of-head localization process performs out-of-head localization by using personal spatial acoustic transfer characteristics (which are also called a spatial acoustic transfer function) and ear canal transfer characteristics (which are also called an ear canal transfer function). In this embodiment, out-of-head localization is achieved by using the spatial acoustic transfer characteristics from speakers to a listener's ears and the ear canal transfer characteristics when headphones are worn.

In this embodiment, the ear canal transfer characteristics, which are characteristics from a headphone speaker unit to the entrance of the ear canal when headphones are worn are used. By carrying out convolution with use of the inverse characteristics of the ear canal transfer characteristics (which are also called an ear canal correction function), it is possible to cancel out the ear canal transfer characteristics. The sound pickup device is used to measure the ear canal transfer characteristics. A user wears headphones while wearing the sound pickup device.

In this state, a microphone of the sound pickup device is placed in the ear hole. Then, the sound pickup device measures an impulse response when impulse sounds from the headphones are output. It is thereby possible to measure the ear canal transfer characteristics from the headphones to the ear or eardrum. Note that the microphone of the sound pickup device may be placed at any position between the ear and the eardrum. The range of the ear is a range including the entrance of the ear canal.

First Embodiment

Figure 1:
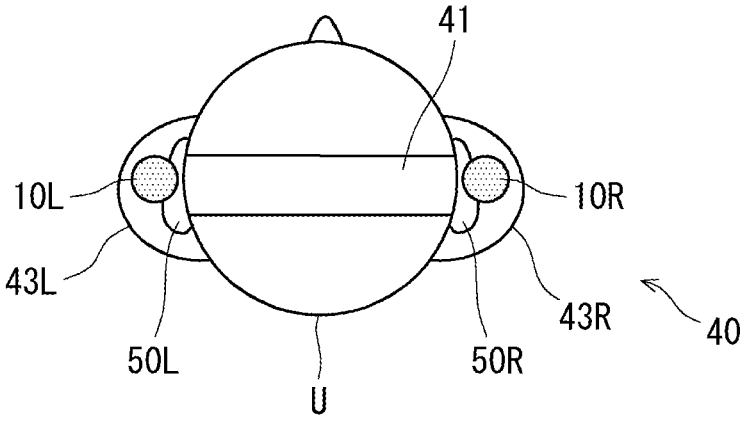
FIG. 1 is a view showing a structure where a sound pickup device picks up sounds output from headphones.

The structure of the sound pickup device according to this embodiment is described hereinafter with reference to FIG. 1. FIG. 1 is a schematic view showing the state where headphones 40 and a sound pickup device 10 are worn by a user U.

The sound pickup device 10L is worn on the left ear 50L of the user U. The sound pickup device 10R is worn on the right ear 50R of the user U. Note that, in the following description, when there is no need to distinguish between the left and right sound pickup devices 10L and 10R, they are referred to as the sound pickup device 10. Likewise, when there is no need to distinguish between the left and right ears 50L and 50R, they are referred to as the ear 50.

The headphones 40 include a headphone band 41, a left unit 43L, and a right unit 43R. The headphone band 41 connects the left unit 43L and the right unit 43R. The left unit 43L outputs a sound toward the left ear 50L of the user U. The right unit 43R outputs a sound toward the right ear 50R of the user U. The type of the headphones 40 may be open, closed, semi-open, semi-closed or any other type. The headphones 40 are worn by the user U with the sound pickup device 10 worn. Specifically, the left unit 43L and the right unit 43R of the headphones 40 are worn on the left ear 50L and the right ear 50R on which the sound pickup device 10L and the sound pickup device 10R are worn, respectively. The headphone band 41 generates an urging force to press the left unit 43L and the right unit 43R against the left ear 50L and the right ear 50R, respectively.

The sound pickup device 10L collects the sound output from the left unit 43L of the headphones 40. The sound pickup device 10R collects the sound output from the right unit 43R of the headphones 40. A microphone part of each of the sound pickup devices 10L and 10R is placed at a sound pickup position near the ear hole. The sound pickup devices 10L and 10R are formed not to interfere with the headphones 40. Specifically, the user U can wear the headphones 40 in the state where the sound pickup devices 10L and 10R are placed at appropriate positions of the left ear 50L and the right ear 50R.

Figure 2:
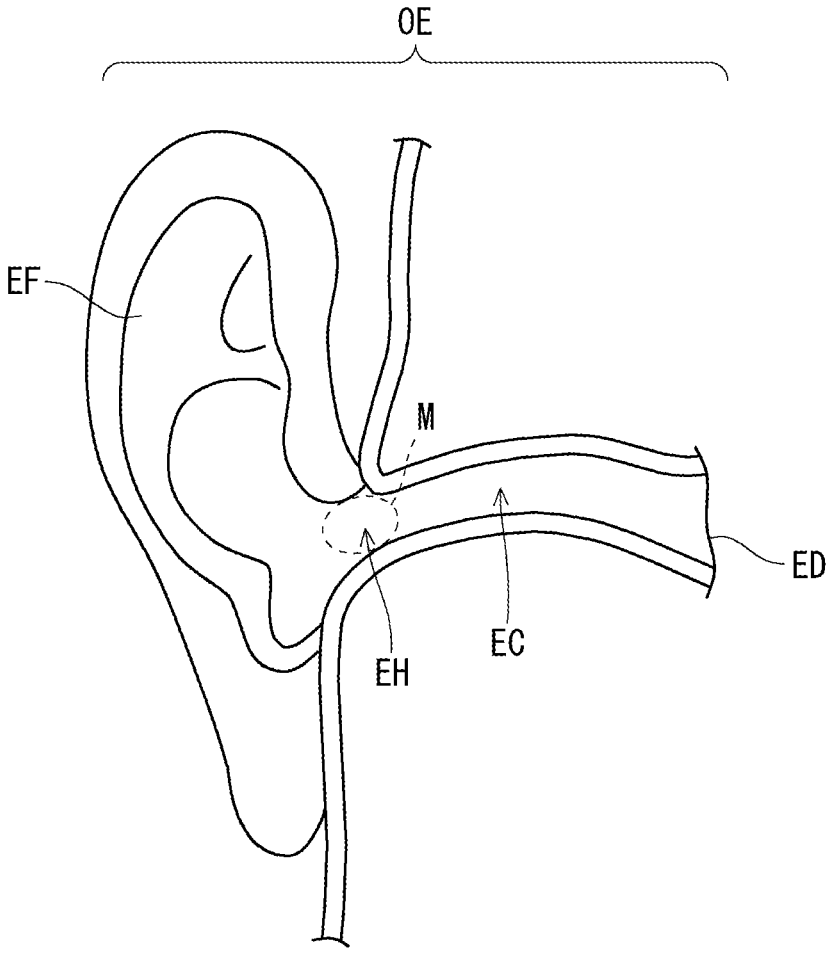
FIG. 2 is a view illustrating each part of the ear and a sound pickup position.

Each part of the ear 50 and the sound pickup position are described hereinafter with reference to FIG. 2. FIG. 2 is a view schematically showing the structure of the outer ear OE of the ear 50. Note that, in the following description, the front-back direction and the up-down direction are the directions based on the user U. For example, the top side of the head of the user is upward, and the neck side is downward. Further, the inner ear side is the inside of the ear 50, and the outer space side is the outside of the ear.

The auricle EF is a part that protrudes from the side of the head and collects sounds. The auricle EF is a shell-like protrusion surrounding the ear hole EH, and it is also called the auditory capsule. The outer ear OE is a part outside of the eardrum ED. The outer ear OE is composed of the ear canal EC and the auricle EF.

The ear canal EC is a canal for transferring sounds collected by the auricle EF to the eardrum ED. The ear canal EC is generally curved in an S-shape. The ear hole EH is an opening that forms the entrance of the ear canal EC. The ear hole EH resides inside the auricle EF, i.e., in a space surrounded by the auricle EF. The ear hole EH generally resides on the lower and front sides of the center of the auricle EF. The ear hole EH is round with a diameter of about 10 mm, which is visible from the outside.

The position at which the microphone part of the sound pickup device 10 is placed is a sound pickup position M. The sound pickup position M is in close proximity to the ear hole EH. The sound pickup position M may be inside the ear canal EC or outside the ear canal EC. The sound pickup position M is preferably close to the eardrum ED.

Figure 3:
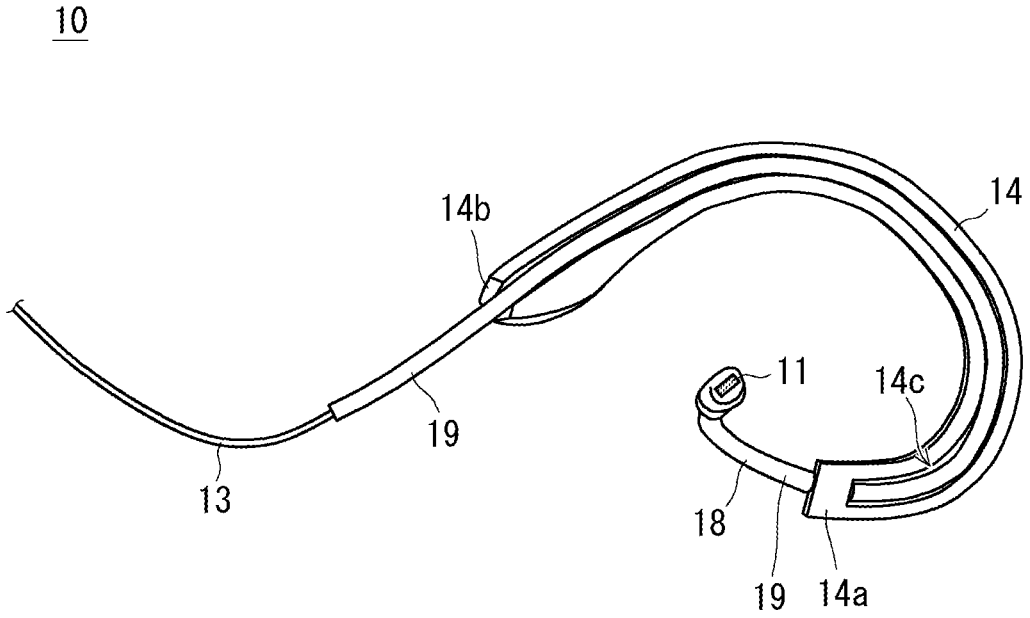
FIG. 3 is a perspective view showing the structure of the sound pickup device.
Figure 4:
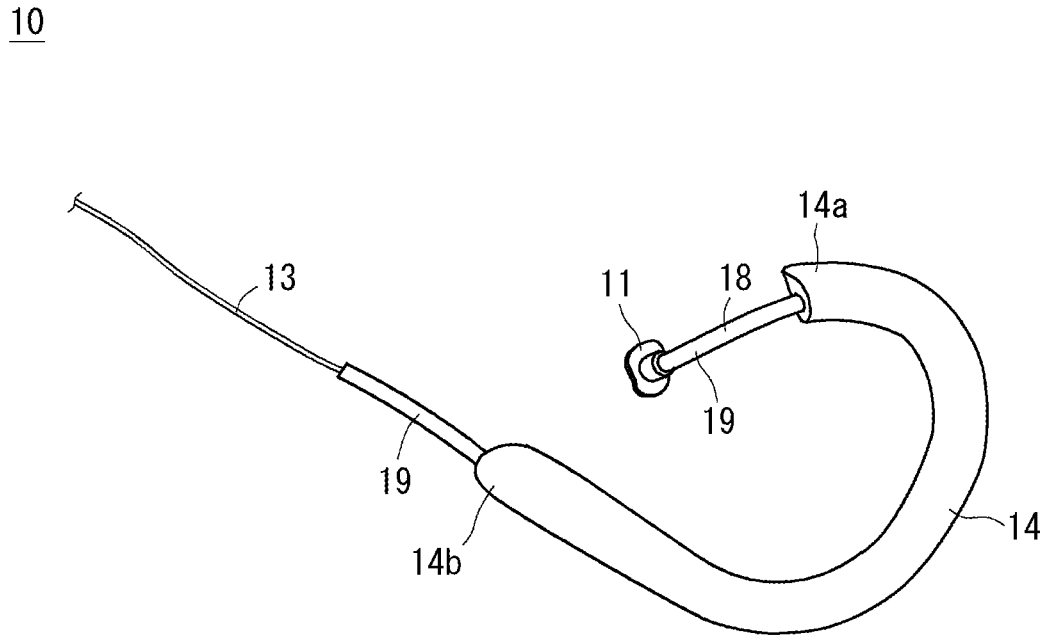
FIG. 4 is a perspective view showing the structure of the sound pickup device.
Figure 5:
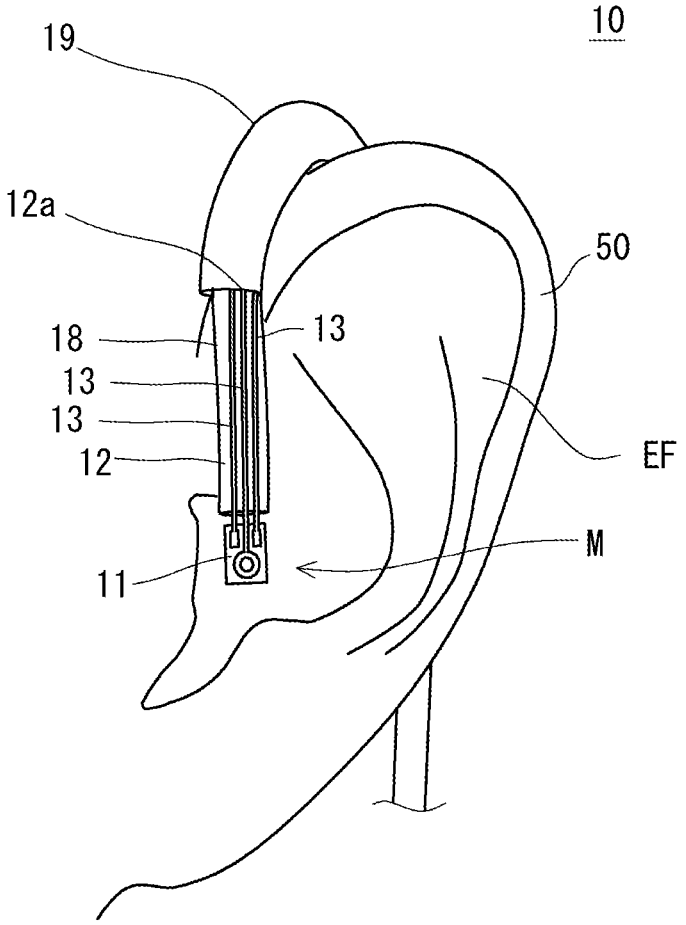
FIG. 5 is a perspective view showing, in a simplified way, the state where the sound pickup device is worn on the ear.
Figure 6:
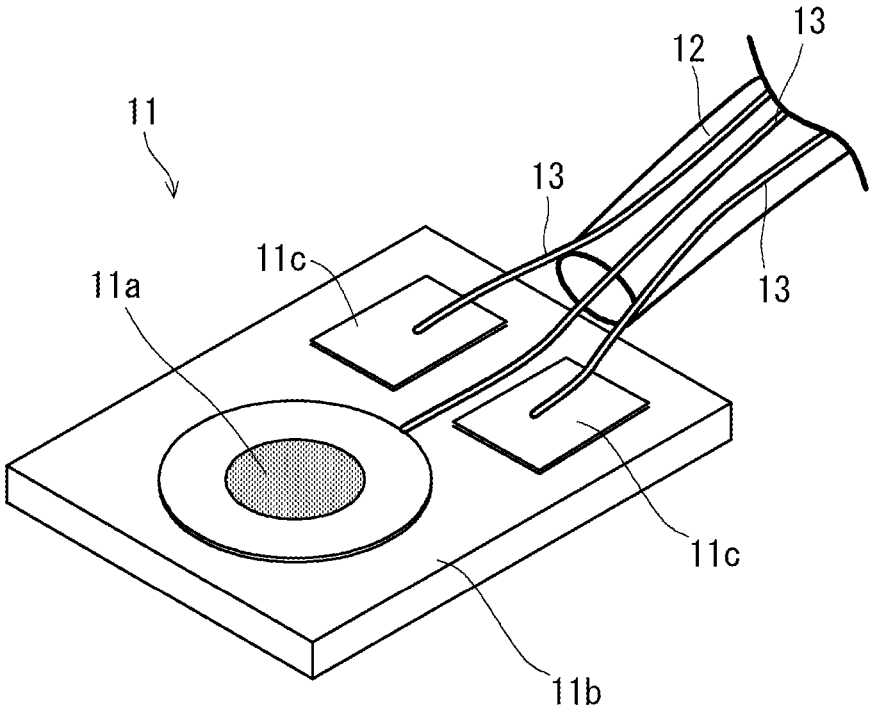
FIG. 6 is an enlarged view showing the structure of a microphone part and its periphery of the sound pickup device.

The structure of the sound pickup device 10 is described hereinafter with reference to FIGS. 3 to 6. FIGS. 3 and 4 are perspective views showing the structure of the sound pickup device 10, which are viewed from different directions. FIG. 5 is a view showing, in a simplified way, the state where the sound pickup device 10 is worn on the ear 50. FIG. 6 is a view showing the structure of a microphone part 11 the sound pickup device 10.

The sound pickup device 10 includes a microphone part 11, a wire 12, a cable 13, a hook part 14, a holding part 18, and a covering 19. For the sake of description, a part of the front edge of the covering 19 and the hook part 14 are omitted in the illustration of FIG. 5. Further, the wire 12 and the cable 13 are simplified into a linear form in FIG. 5. Furthermore, the covering 19 is omitted in the illustration of FIG. 6.

The hook part 14 hooks on the ear 50 and thereby the sound pickup device 10 is worn on the ear 50. The hook part 14 is formed in an inverse J-shape so that it hangs from the auricle. The hook part 14 is curved to hook along the auricle EF from its backside, upper side and to front side. Specifically, the hook part 14 passes between the auricle EF and the head on the backside of the auricle EF. The hook part 14 is made of resin such as silicone resin, for example. The hook part 14 is preferably formed to be deformable to fit the shape of the auricle EF. The hook part 14 has a shape similar to the shape of a hook part of ear-hook earphones.

The holding part 18 extends from a front end 14*a* of the hook part 14. The holding part 18 is a part projecting from the hook part 14, and it is placed on the front side of the auricle EF. The microphone part 11 is placed at the leading end of the holding part 18. The holding part 18 ranges from the front end 14*a* of the hook part 14 to the microphone part 11. The holding part 18 is disposed between the hook part 14 and the microphone part 11 in order to hold the microphone part 11 at the sound pickup position in close proximity to the ear hole. The holding part 18 extends from the upper side of the auricle EF down to the sound pickup position.

The holding part 18 has the covering 19. As shown in FIG. 5, the covering 19 covers the wire 12 and the cable 13. The covering 19 is tubular to wrap around the wire 12 and the cable 13. Thus, the wire 12 and the cable 13 pass through the inside of the covering 19. In other words, the wire 12 and the cable 13 are enclosed by the covering 19. The covering 19 is made of an elastic resin material or rubber, for example. The holding part 18 is composed of the wire 12, the cable 13 and the covering 19. Note that the hook part 14 and the covering 19 in the holding part 18 are omitted in the illustration of FIG. 5. Therefore, in FIG. 5, a position corresponding to the front end 14*a* of the hook part 14 is a hook end 12*a* of the wire 12.

As shown in FIG. 3, the hook part 14 has a groove 14*c* to let the covering 19 pass through. The groove 14*c* is formed from the front end 14*a* to a back end 14*b* along the shape of the hook part 14. The covering 19 extends from the front end 14*a* to the back end 14*b* of the hook part 14 through the groove 14*c* of the hook part 14. Specifically, the covering 19 enclosing the cable 13 and the wire 12 is fit into the groove 14*c*.

Thus, the cable 13 is placed along the hook part 14. As shown in FIGS. 3 and 4, the cable 13 is drawn from the back end 14*b* of the hook part 14. Note that, the hook part 14 may have a though hole, instead of the groove 14*c*, in order to let the cable 13 pass through the hook part 14. The cable 13 includes a signal cable, a power supply cable, a ground cable or the like. Each of the signal cable, the power supply cable and the ground cable is a covered electric wire.

The wire 12 runs to the middle of the hook part 14. The wire 12 does not need to run to the back end 14*b* of the hook part 14. For example, the wire 12 may be attached to the hook part 14 near the front end 14*a* of the hook part 14. The wire 12 only needs to be placed on the holding part 18. The wire 12, however, may extend to the back end 14*b* of the hook part 14 as a matter of course.

The microphone part 11 resides at the leading end of the holding part 18. The microphone part 11 is placed at the sound pickup position M in close proximity of the ear hole. The microphone part 11 placed at the sound pickup position M picks up the sound emitted from the headphones 40 toward the ear canal. The microphone part 11 is placed at the sound pickup position M so as not to block the ear hole, and picks up a measurement signal output from the headphones 40. The measurement signal is an impulse sound, for example.

The microphone part 11 includes a microphone element 11*a*, a substrate 11*b*, and a terminal 11*c* as shown in FIG. 6. The substrate 11*b* is smaller than the ear hole, and its size is 3 mm×4 mm, for example. The microphone element 11*a* is an MEMS (Micro Electro Mechanical Systems) microphone that is formed on the substrate 11*b*. Thus, the microphone element 11*a* is mounted on the substrate 11*b*. The terminal 11*c* is formed on the edge of the substrate 11*b*. The terminal 11*c* is a power supply terminal, a signal terminal, a ground terminal or the like of the microphone element 11*a*. Therefore, the cable 13, which is the signal cable, the power supply cable and the ground cable, is connected to the terminal 11*c*. A line between the microphone element 11*a* and the terminal 11*c* is formed on the substrate 11*b*.

Three cables, i.e., the signal cable, the power supply cable and the ground cable, are placed in FIG. 6. The signal cable transmits a sound pickup signal of the microphone element 11*a*. The power supply cable supplies power to the microphone element 11*a*. The ground cable connects a ground terminal of the microphone element 11*a* to the ground. The number of cables is not particularly limited.

The microphone element 11*a* is placed facing the outside of the ear 50, which is the outside of the ear canal EC. The microphone element 11*a* can thus picks up the sound output from the headphones. It is thereby possible to measure the ear canal transfer characteristics from the headphones to the sound pickup position.

The wire 12 is placed in close proximity to the microphone part 11. To be specific, the microphone part 11 is placed near the leading end of the wire 12. Note that the microphone part 11 may be fixed or not fixed to the wire 12.

The wire 12 is a flexible wire, for example. The wire 12 is a metal line with a diameter of 0.9 mm, for example. The wire 12 may be any material that is freely bendable and fixable. The wire 12 is plastically-deformed when the user U bends or curves the wire 12. The wire 12 can be thereby maintained in an arbitrary deformed shape. This enables the wire 12 to be deformed into a shape which a user can easily wear on the ear 50. It is thereby possible to adjust the position of the microphone part 11 in such a way that the sound pickup position becomes appropriate. Further, the wire 12 is wider than the cable 13. By the wire 12, the microphone part 11 is held in the air of the ear canal. For example, the microphone part 11 is held in the state where the substrate 11*b* is not in contact with the outer ear. It is thus possible to place the microphone part 11 at a desired sound pickup position.

Note that, in the holding part 18, the cable 13 is placed along the wire 12. To be specific, in the holding part 18, the cable 13 is attached to the wire 12 by the covering 19. The cable 13 is connected to an A/D converter and audio equipment including a memory or the like. The sound pickup signal is thereby stored.

The wire 12 is deformable so as to place the microphone part 11 at a desired sound pickup position M. An adjuster deforms the wire 12 while the user U is wearing the sound pickup device 10. For example, an adjuster bends the wire 12 to adjust the sound pickup position M. This allows the microphone part 11 to be placed at an appropriate sound pickup position. The adjuster may be the user U or a person other than the user U.

Further, the adjuster deforms the wire 12 in such a way that the microphone element 11*a* faces a desired direction. For example, the adjuster can adjust the direction of the microphone element 11*a* by twisting or bending the wire 12. To be specific, the microphone part 11 rotates when the wire 12 is twisted around the axis in the extending direction of the wire 12. The sound pickup direction can be thereby adjusted. Note that, although FIG. 5 shows a simplified illustration where the wire 12 is in a linear form in the holding part 18, at least part of the wire 12 is formed along the auricle EF. It is thereby possible to easily adjust the direction and position of the microphone element 11*a*. For example, the direction of the wire 12 may be adjustable at the front end 14*a* of the hook part 14. This enables measurement at the appropriate sound pickup position M. Further, at least part of the wire 12 may be in contact with the auricle EF between the front end 14*a* of the hook part 14 and the sound pickup position M. Alternatively, the wire 12 may be in no contact with the auricle EF.

After deforming the wire 12 in such a way that the microphone part 11 comes to an appropriate position and faces an appropriate direction, the user U wears the headphones 40. Then, impulse response measurement is performed with the sound pickup device 10 and the headphones 40 worn on the left and right ears 50. Specifically, the sound pickup device 10 picks up the measurement signals output from the headphones 40. The ear canal transfer characteristics are thereby measured.

The microphone part 11 is placed in a space inside the auricle EF, and only the holding part 18 extends from the inside to the outside of the auricle EF. Therefore, the headphones 40 and the sound pickup device 10 do not physically interfere with each other when the user U wears the headphones 40 and the sound pickup device 10. Thus, the position and direction of the microphone part 11 are not shifted even when the user U wears the headphones 40 over the sound pickup device 10. This enables picking up sounds at the appropriate sound pickup position M. Because the sound pickup position M does not change during measurement, it is possible to appropriately measure the ear canal transfer characteristics.

Further, because the microphone part 11 is smaller than the ear canal, the sound pickup device 10 can pick up sounds without blocking the ear canal. Specifically, the size of the substrate 11*b* of the microphone part 11 is smaller than the diameter of the ear canal. This enables measurement of the ear canal transfer characteristics in consideration of echoes in the ear canal. It is thereby possible to appropriately measure the ear canal transfer characteristics.

Note that the wire 12 may pass through the inside of the hook part 14. This enables deformation of the hook part 14. The shape of the hook part 14 can be adjusted to fit the shape of the ear 50. By deforming the hook part 14 so as to come into close contact with the ear 50, it is possible to prevent the sound pickup position M from being shifted.

Further, because the wire 12 is deformable, the microphone part 11 can be adjusted in accordance with the user U. This enables measurement at the appropriate sound pickup position M for each user U. It is thereby possible to appropriately measure the ear canal transfer characteristics for each user U. Further, the sound pickup device 10 in a different size may be prepared depending on the size of the ear 50. Then, measurement may be performed using the pickup device 10 in a suitable size for the user U.

Although the cable 13 is attached to the wire 12 by the covering 19 in the holding part 18 in the above-described structure, the cable 13 may be attached to the wire 12 by an adhesive tape or the like. Thus, the sound pickup device 10 does not necessarily have the covering 19. Note that, because the hook part 14 is fixed to the ear 50, the length of the hook part 14 is preferably at least half the length of the auricle EF. Further, the cable 13 of the left and right sound pickup devices 10L and 10R may be pulled downward of the user U's face to fix the sound pickup devices 10L and 10R by an urging force.

Note that, although the cable 13 is formed along the wire 12 in this embodiment, the cable 13 is not necessarily placed. Thus, the sound pickup device 10 may have a structure without the cable 13. For example, a signal from the microphone part 11 may be transmitted by radio communication. In this case, a circuit or a battery for radio communication may be mounted on the substrate 11*b*. Alternatively, the wire 12 may be used as the signal or power supply cable 13.

MODIFIED EXAMPLE 1

Figure 7:
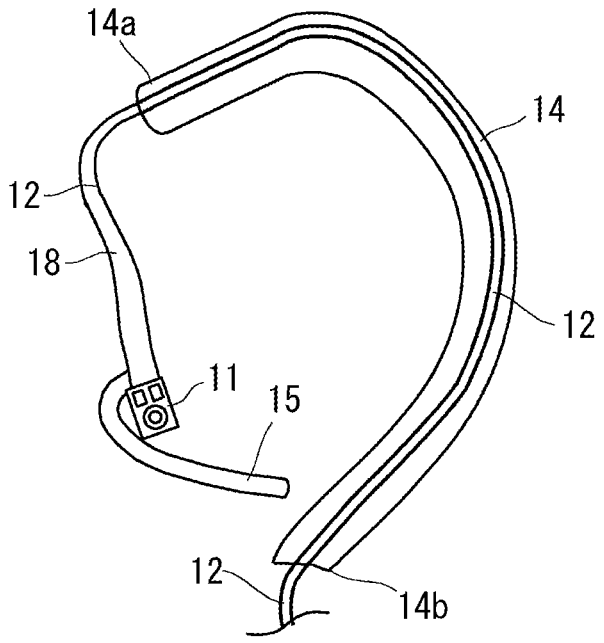
FIG. 7 is a view showing the structure of a sound pickup device according to a modified example 1.

A sound pickup device 10A according to a modified example 1 of the first embodiment is described hereinafter with reference to FIG. 7. FIG. 7 is a perspective view showing the structure of the sound pickup device 10A. In the sound pickup device 10A, a contact part 15 is added to the sound pickup device 10 described in the first embodiment. The basic structure of the sound pickup device 10A is the same as that of the sound pickup device 10 according to the first embodiment, and the description thereof is omitted. Further, in FIG. 7, the cable 13 is omitted. The sound pickup device 10A has a structure that does not include the covering 19.

The wire 12 has the contact part 15. Specifically, the contact part 15 is formed by a part of a wire that forms the wire 12. Alternatively, the contact part 15 may be made of a different material from the wire 12. For example, the contact part 15 may be made of an elastic material such as resin. The contact part 15 is formed by bending the wire 12 in close proximity to the microphone part 11. The contact part 15 extends from the microphone part 11 to the inside of the auricle. One end of the contact part 15 is placed at a sound pickup position, and the other end of the contact part 15 is in contact with the auricle. The contact part 15 is pressed against the auricle so that the position of the microphone part 11 is not shifted from an appropriate sound pickup position. The contact part 15 is in contact with the inside of the auricle. This prevents the sound pickup position from being shifted.

Further, the wire 12 extends from the back end 14*b* of the hook part 14. Specifically, the wire 12 is formed longer than the hook part 14 and drawn from the both ends of the hook part 14. An adjuster can elongate the holding part 18 from the back end 14*b* side. By pulling the wire 12 and the cable 13 from the back end 14*b*, the length of the holding part 18 can be shortened. Alternatively, by pressing the wire 12 and the cable 13 from the back end 14*b* toward the front end 14*a*, the length of the holding part 18 can be elongated.

In this manner, it is possible to adjust the length of the holding part 18 depending on the size of the ear 50. This enables adjustment of the length of the wire 12 from the front end 14*a* of the hook part 14 to the sound pickup position M. It is thereby possible to measure the ear canal transfer characteristics at the appropriate sound pickup position M for each user U.

Further, the wire 12 passes through the inside of the hook part 14. This allows plastic deformation of the wire 12 in the hook part 14 and thereby deforms the hook part 14. The shape of the hook part 14 can be adjusted depending on the size of the ear 50. It is thereby possible to deform the hook part 14 so as to come into close contact with the ear 50, and prevent the sound pickup position M from being shifted.

The above-described sound pickup device 10 can measure the spatial transfer characteristics such as HRTF (head-related transfer function). Thus, the sound pickup device 10 can measure the spatial transfer characteristics from a sound source such as a speaker to the ears. Measuring the ear canal transfer characteristics and the spatial transfer characteristics by the same sound pickup device 10 enables highly accurate measurement. It is thereby possible to perform out-of-head localization appropriately.

MODIFIED EXAMPLE 2

Figure 8:
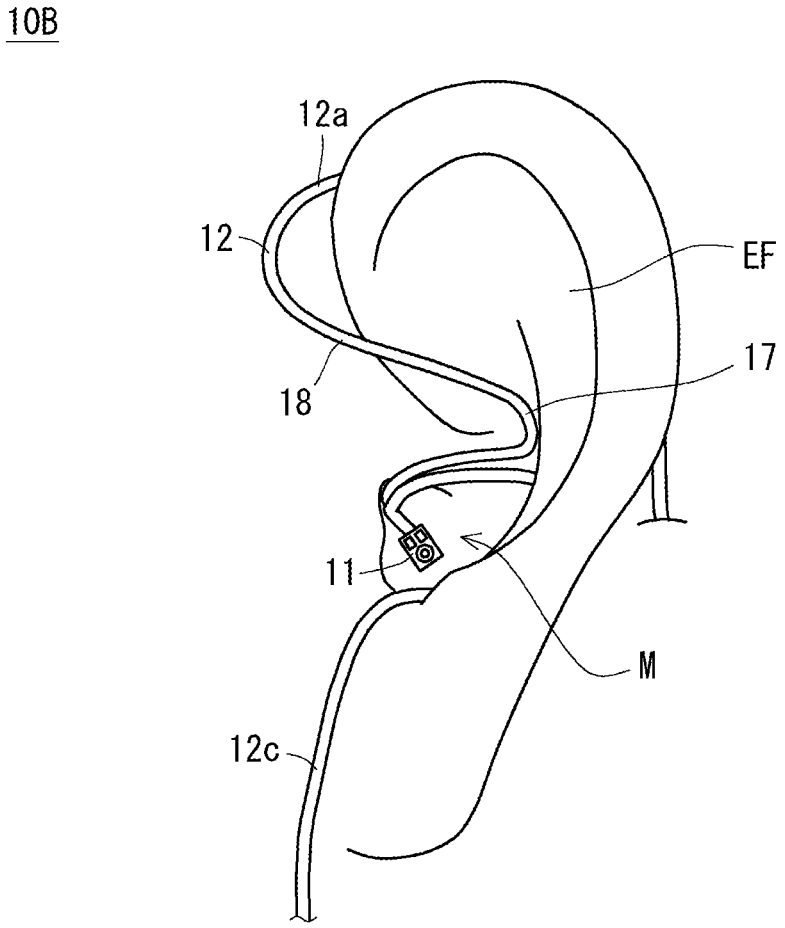
FIG. 8 is a view showing the state where a sound pickup device according to a modified example 2 is worn.
Figure 9:
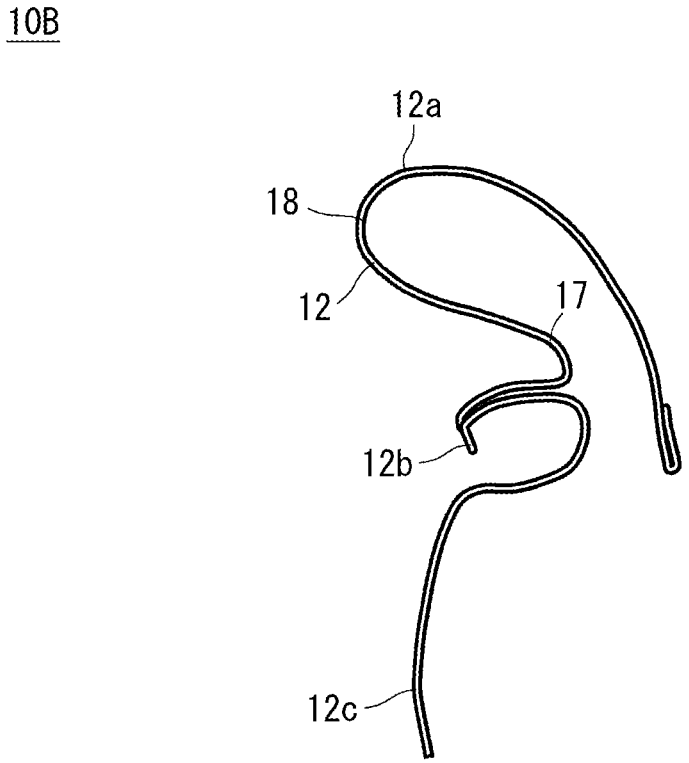
FIG. 9 is a view showing the structure of the sound pickup device according to the modified example 2.

The shape of a wire 12 in a sound pickup device 10B according to a modified example 2 of the first embodiment is described hereinafter with reference to FIGS. 8 and 9. FIGS. 8 and 9 are perspective views showing the shape of the wire 12 in the sound pickup device 10B according to this embodiment. FIG. 8 only shows the wire 12 and the microphone part 11, and the illustration of the hook part 14 and the cable 13 is omitted. Further, FIG. 9 shows the shape of the wire 12, and the microphone part 11, the hook part 14, the cable 13 and the like are not shown.

In FIG. 9, a position where the microphone part 11 is placed is a microphone position 12*b* of the wire 12. FIG. 8 shows the state where the sound pickup device 10B is worn on the ear 50, and FIG. 9 shows the state where it is not worn on the ear 50.

The sound pickup device 10B is different from the sound pickup device 10 described in the first embodiment in the shape of the wire 12. To be specific, a curved part 17 is added to the wire 12. The description of the elements common to those in the sound pickup device 10 of the first embodiment is omitted as appropriate.

The wire 12 is formed along the groove of the auricle EF in a part of an area from one end 14*a* of the hook part 14 to the sound pickup position M. To be specific, the wire 12 is placed in such a way that the curved part 17 is fit into the groove of the auricle EF. The wire 12 has the curved part 17 that generates an urging force. For example, a part of the wire 12 extending from the sound pickup position M is curved to form the curved part 17. To be specific, the curved part 17 is formed by bending the wire 12 into a U-shape. In this example, the curved part 17 resides between the hook end 12*a* of the wire 12 to the microphone part 11. The curved part 17 is formed in the middle of the holding part 18. Although the curved part 17 is placed above the microphone position 12*b* in FIG. 9, it may be placed therebelow.

The curved part 17 is fit into a groove or hollow inside the auricle EF, and thereby the curved part 17 generates an urging force. The urging force is a force in the direction where the curved part 17 opens up. The wire 12 is urged inside the auricle EF by the urging force generated in the curved part 17, and thereby the sound pickup device 10B is fixed. This ensures to fix the sound pickup device 10B to the auricle EF. The sound pickup device 10B is held inside the auricle EF in the state where the microphone part 11 is placed at the appropriate sound pickup position M. It is thus possible to reliably fix the sound pickup device 10B so that the position of the microphone part 11 is not shifted from the appropriate sound pickup position M. This enables picking up sounds with the microphone part 11 placed at the appropriate sound pickup position M.

Further, the wire 12 is bent in a U-shape at the microphone position 12*b* of the wire 12. A part of the wire 12 which is folded in a U-shape is used as a seat for the microphone part 11, which ensures to fix the microphone part 11 to the wire 12. This prevents the sound pickup position M from being shifted.

Further, an extension part 12*c* extends on the lower side of the auricle EF. The holding part 18 resides above the microphone position 12*b*, and the extension part 12*c* resides below the microphone position 12*b*. The holding part 18 and the extension part 12*c* extend from the inside to the outside of the auricle EF.

MODIFIED EXAMPLE 3

Figure 10:
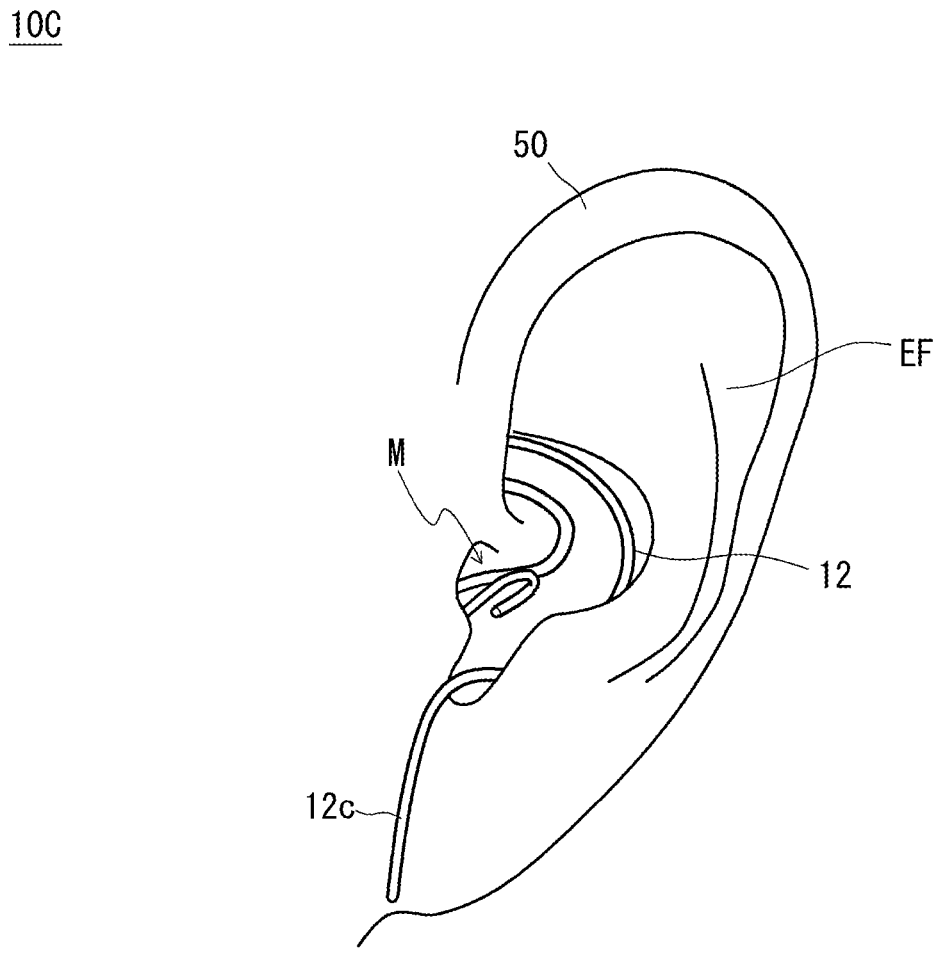
FIG. 10 is a view showing the state where a sound pickup device according to a modified example 3 is worn.
Figure 11:
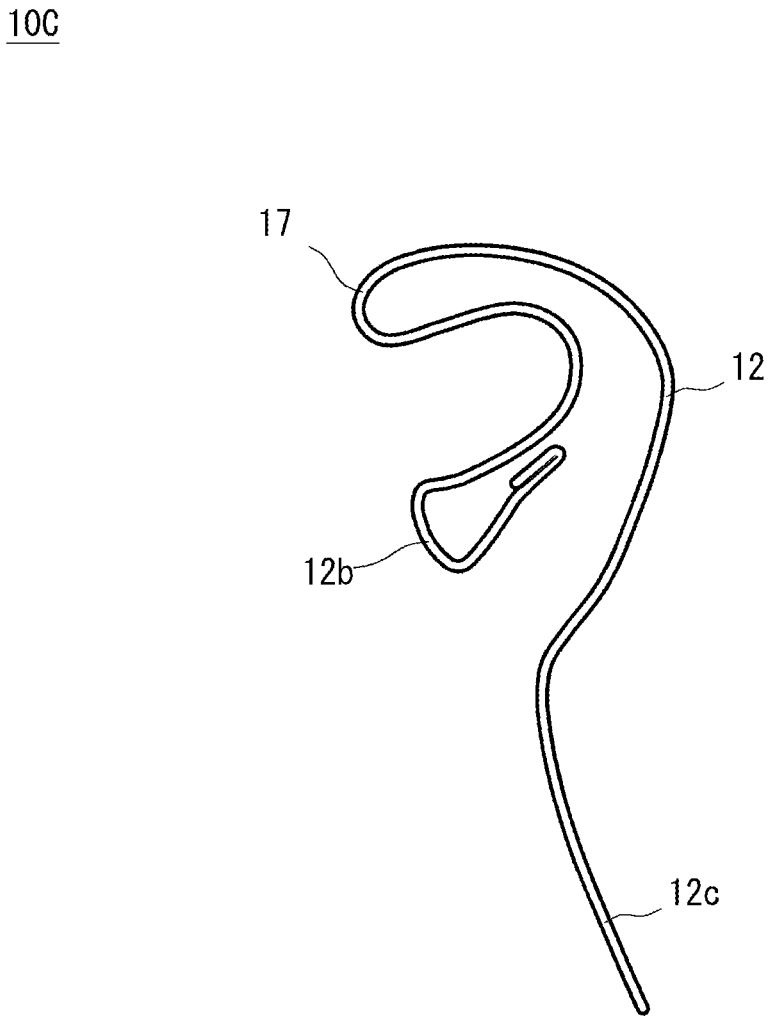
FIG. 11 is a view showing the structure of the sound pickup device according to the modified example 3.

The shape of a wire 12 in a sound pickup device 10C according to a modified example 3 is described hereinafter with reference to FIGS. 10 and 11. FIGS. 10 and 11 are perspective views showing the shape of the wire 12 in the sound pickup device 10C according to this embodiment. FIGS. 10 and 11 only show the wire 12, and the illustration of the cable 13, the microphone part 11 and the like is omitted. Thus, in FIG. 11, a position where the microphone part 11 is placed is a microphone position 12*b* of the wire 12. FIG. 10 shows the state where the sound pickup device 10C is worn on the ear 50, and FIG. 11 shows the state where it is not worn on the ear 50.

The sound pickup device 10C is different from the sound pickup device 10B of the modified example 2 in that the hook part 14 is not included. Thus, this structure does not have the holding part 18 from the hook part 14 to the sound pickup position M. This effectively prevents interference between the sound pickup device 10C and the headphones 40. The extension part 12*c* of the wire 12 runs from the downside of the auricle EF to the outside of the auricle EF. The cable 13 runs to the outside of the auricle along the extension part 12*c*.

The wire 12 has a curved part 17 formed along the internal surface shape of the auricle EF. In the sound pickup device 10C, the sound pickup device 10C is fixed inside the auricle EF only by an urging force of the curved part 17. The curved part 17 is fit into a groove or hollow inside the auricle EF, and thereby the curved part 17 generates an urging force. The wire 12 is urged and fixed inside the auricle EF by the urging force generated in the curved part 17. This ensures to fix the sound pickup device 10C to the auricle EF.

The sound pickup device 10C is held in the auricle EF in the state where the microphone part 11 is placed at the appropriate sound pickup position M. It is thus possible to reliably fix the sound pickup device 10C so that the position of the microphone part 11 is not shifted from the appropriate sound pickup position M. This enables picking up sounds with the microphone part 11 placed at the appropriate sound pickup position M. The same effects as the effects of the first embodiment and its modified examples are obtained in this structure.

MODIFIED EXAMPLE 4

Figure 12:
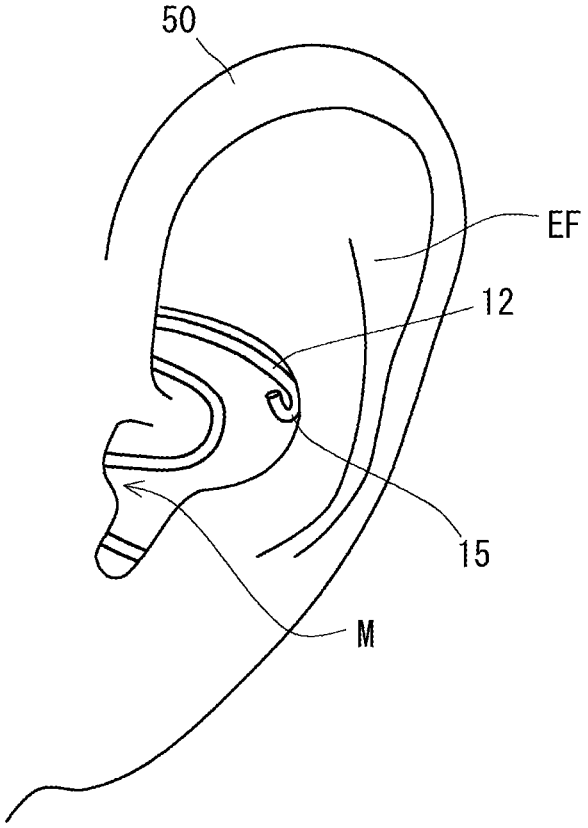
FIG. 12 is a view showing the state where a sound pickup device according to a modified example 4 is worn.
Figure 13:
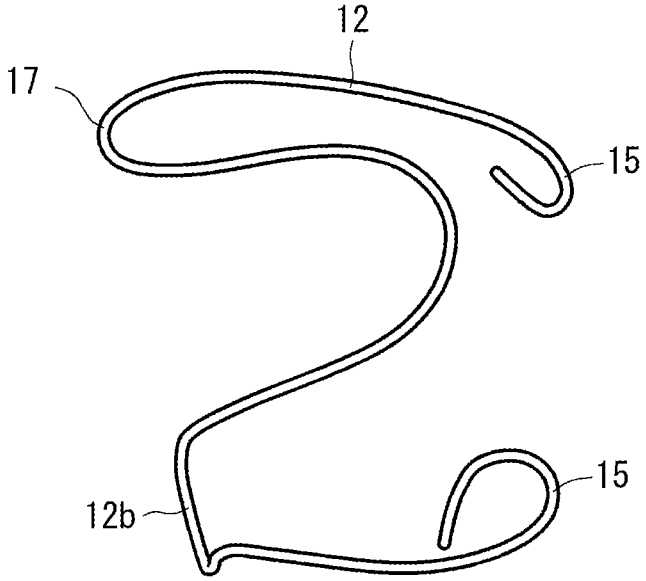
FIG. 13 is a view showing the structure of the sound pickup device according to the modified example 4.

The shape of a wire 12 in a sound pickup device 10D according to a modified example 4 is described hereinafter with reference to FIGS. 12 and 13. FIGS. 12 and 13 are perspective views showing the shape of the wire 12 in the sound pickup device 10D according to this embodiment. FIGS. 12 and 13 only show the wire 12, and the illustration of the microphone part 11, the cable 13 and the like is omitted. Thus, in FIG. 13, a position where the microphone part 11 is placed is a microphone position 12*b* of the wire 12. FIG. 12 shows the state where the sound pickup device 10D is worn on the ear 50, and FIG. 13 shows the state where it is not worn on the ear 50.

The modified example 4 is different from the modified example 3 in that the wire 12 does not have the extension part 12*c*. The wire 12 is placed only inside the auricle EF in this structure. Only the cable (not shown) runs to the outside of the auricle EF. The cable may run from the upside of the sound pickup position M to the outside of the auricle EF, or may run from the downside of the sound pickup position M to the outside of the auricle EF.

In the modified example 4 also, the wire 12 has the curved part 17. The sound pickup device 10D is worn on the ear 50 by an urging force generated by the curved part 17. Further, the wire 12 has the contact part 15 at both ends. The contact part 15 is pressed against the auricle EF. This effectively prevents the sound pickup device 10D from being shifted.

In the structure of the sound pickup device 10D also, the same effects as the sound pickup device 10, 10A to 10C are obtained. Note that the first embodiment and its modified examples 1 to 4 may be combined as appropriate. For example, the contact part 15 described in the modified example 1 and the curved part 17 described in the modified examples 2 to 4 and the like may be combined. Specifically, the microphone part 11 may be held at the sound pickup position M by using the wire 12 having the contact part 15 and the curved part 17.

Second Embodiment

Figure 14:
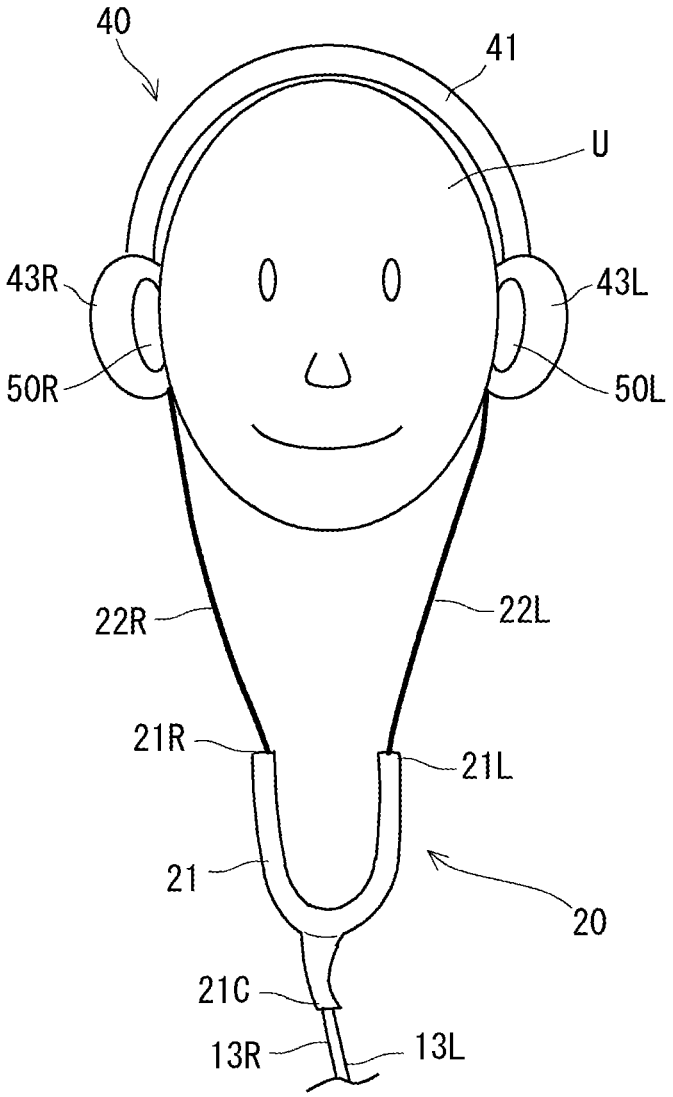
FIG. 14 is a front view schematically showing the state where a sound pickup device according to a second embodiment is worn.
Figure 15:
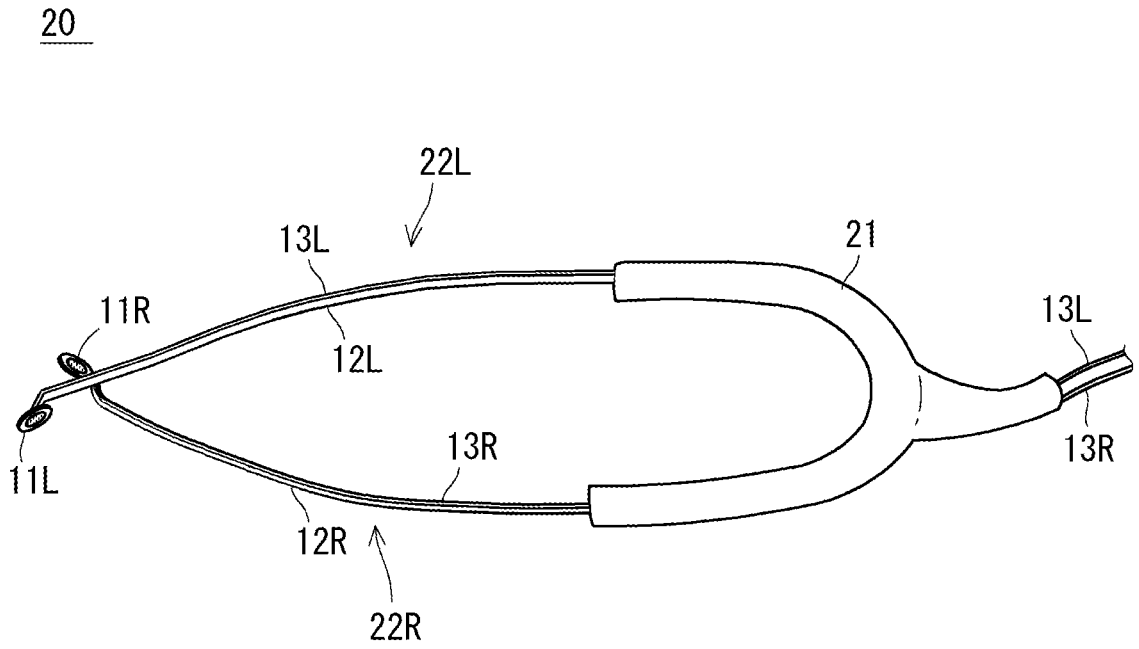
FIG. 15 is a perspective view schematically showing the structure of the sound pickup device according to the second embodiment.

A sound pickup device 20 according to this embodiment is described hereinafter with reference to FIGS. 14 and 15. FIG. 14 is a front view schematically showing the state where the user U wears the sound pickup device 20 and the headphones 40. FIG. 15 is a view showing the detailed structure of the sound pickup device 20.

As shown in FIG. 14, the sound pickup device 20 has a stethoscope-like structure. To be specific, the sound pickup device 20 includes a left sound pickup unit 22L, a right sound pickup unit 22R, and a connection part 21 that connects the left and right sound pickup units 22L and 22R.

The left and right sound pickup units 22L and 22R have the same structure. The left and right sound pickup units 22L and 22R are bilaterally symmetric. The connection part 21 connects the left sound pickup unit 22L and the right sound pickup unit 22R. The connection part 21 is in a trident form. The left sound pickup unit 22L is attached to a first end 21L of the connection part 21, and the right sound pickup unit 22R is attached to a second end 21R of the connection part 21. Further, cables 13L and 13R from the sound pickup units 22L and 22R are drawn from a third end 21C of the connection part 21.

The connection part 21 is placed below the user U's face when viewed from the front. The sound pickup unit 22L runs from the connection part 21 to the left ear 50L through the left side (the right side in FIG. 14) of the user U's face. The sound pickup unit 22R runs from the connection part 21 to the right ear 50R through the right side (the left side in FIG. 14) of the user U's face. The sound pickup unit 22L is worn on the left ear 50L from below. The sound pickup unit 22R is worn on the right ear 50R from below.

The sound pickup unit 22L includes a cable 13L and a wire 12L as described in the first embodiment. The cable 13L is formed along the wire 12L. A microphone part 11L is placed at the leading end of the left sound pickup unit 22L. Likewise, the sound pickup unit 22R includes a cable 13R and a wire 12R. The cable 13R is formed along the wire 12R. A microphone part 11R is placed at the leading end of the right sound pickup unit 22R. The structure of the microphone parts 11L and 11R is the same as that shown in FIG. 6, and the description thereof is omitted.

The wire 12L is inserted and fixed to the first end 21L of the connection part 21. The wire 12R is inserted and fixed to the second end 21R of the connection part 21. The cable 13L is inserted to the first end 21L of the connection part 21. The cable 13R is inserted to the second end 21R of the connection part 21. As described earlier, the cables 13L and 13R pass through the inside of the connection part 21 and are drawn from the third end 21C of the connection part 21.

The connection part 21 generates an urging force to the left and right sound pickup units 22L and 22R. To be specific, the connection part 21 generates an urging force in the direction where the left and right sound pickup units 22L and 22R come close to each other. The sound pickup units 22L and 22R are thereby placed to put the user U's face therebetween. This prevents the microphone part 11 from being shifted. Further, the wires 12L and 12R and the cables 13L and 13R are drawn from the lower side of the left ear 50L and the right ear 50R, respectively. This prevents the headphones 40 and the sound pickup device 20 from interfering with each other.

In the first and second embodiments, an adjuster adjusts the sound pickup position M while the user U wears the sound pickup device 10 or 20. Specifically, the sound pickup position M can be placed at an appropriate position by deforming the wire 12. Further, the sound pickup direction can be adjusted by deforming the wire 12 so as to change the direction of the microphone part 11. The wire 12 may be deformed in the state where the sound pickup device 10 or 20 is worn by the user U or where they are not worn. After adjusting the sound pickup position M at an appropriate position, the user U wears the headphones 40. The headphones 40 are worn over the sound pickup device 10 or 20.

Then, impulse sound measurement is performed while the user U is wearing the sound pickup device 10 or 20 and the headphones 40. Specifically, the sound pickup device 10 or 20 picks up impulse sounds output from the headphones 40. It is thereby possible to appropriately measure the ear canal transfer characteristics.

Third Embodiment

Figure 16:
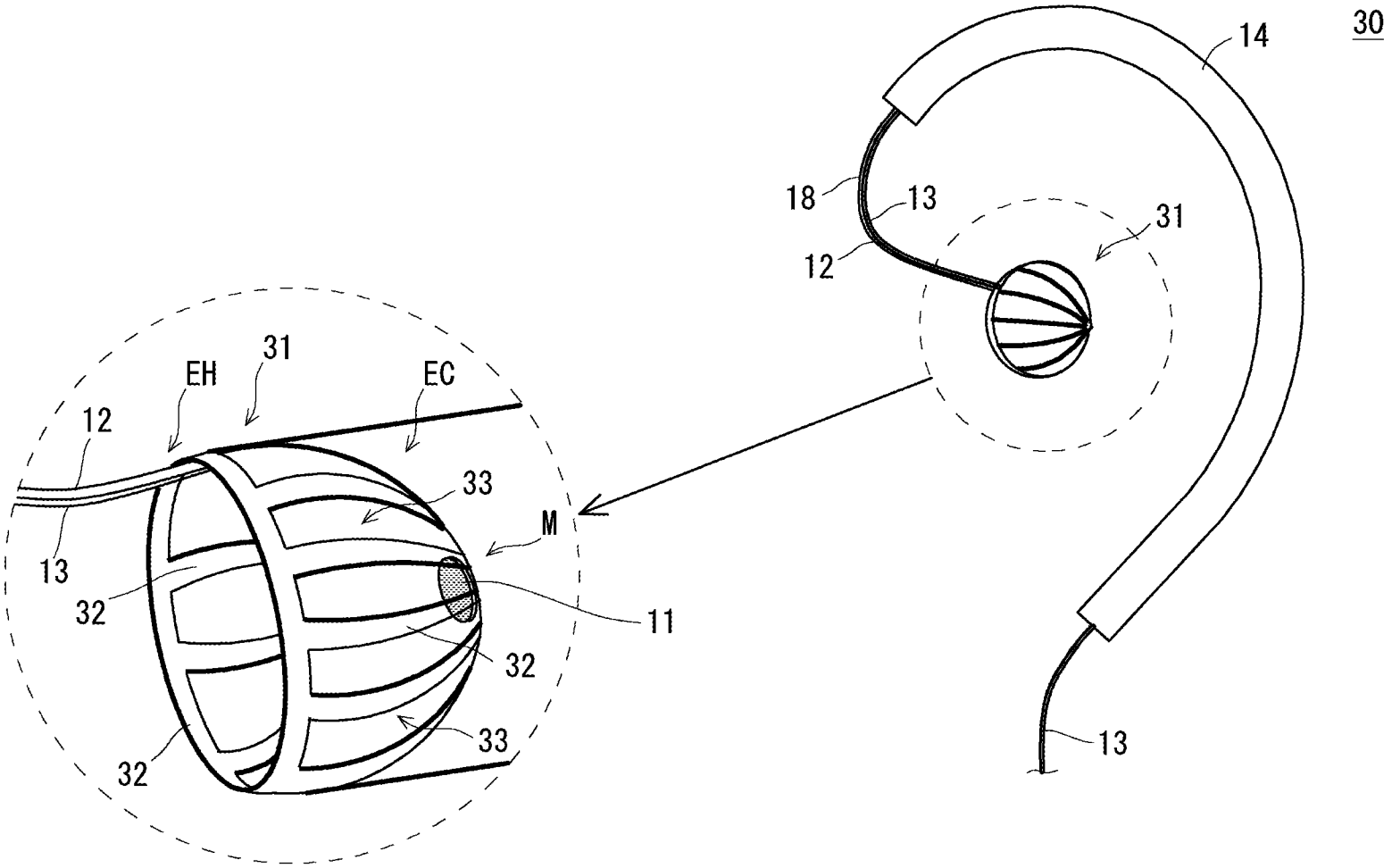
FIG. 16 is a perspective view schematically showing the structure of a sound pickup device according to a third embodiment.

A sound pickup device 30 according to this embodiment is described hereinafter with reference to FIG. 16. FIG. 16 is a view schematically showing the structure of the sound pickup device 30. This third embodiment is different from the first embodiment in that an insertion part 31 is placed at the leading end of the holding part 18. To be specific, the sound pickup device 30 includes a hook part 14, a holding part 18 and the insertion part 31. The hook part 14 and the holding part 18 are the same as those of the first embodiment, and the description thereof is omitted as appropriate.

The holding part 18 includes a cable 13 and a wire 12 as described in the first embodiment. The insertion part 31 is placed at the leading end of the holding part 18. The insertion part 31 is inserted into the ear canal. FIG. 16 shows an enlarged view of the insertion part 31 when the sound pickup device 30 is worn. As shown in the enlarged view of FIG. 16, the insertion part 31 includes a frame part 32 and a microphone part 11.

The insertion part 31 has a dome-shaped frame part 32, which has an opening 33 between frames. To be specific, the frame part 32 has a hemispherical framework. The inside space and the outside space of the ear canal EC are connected through the opening 33. The microphone part 11 is fixed to the frame part 32. To be specific, the microphone part 11 is placed at the top of the frame part 32. The microphone part 11 is attached to the frame part 32, facing the outside of the ear canal EC. The frame part 32 is attached to the holding part 18. The cable 13 from the holding part 18 is placed along the frame part 32. The cable 13 is connected to the microphone part 11. Further, the wire 12 is attached to the frame part 32.

The frame part 32 is made of elastic resin or the like. The outside diameter of the insertion part 31 is the same or slightly larger than the diameter of the ear canal EC. The frame part 32 is fit into the ear canal EC with the top of the frame part 32 placed to the back of the ear canal EC. Because the insertion part 31 is inserted into the ear canal EC, the microphone part 11 is placed at the sound pickup position M in close proximity to the entrance of the ear hole EH.

This structure prevents the sound pickup position M from being shifted. Further, the frame part 32 has the opening 33. Thus, even when the insertion part 31 is fit into the ear canal EC, the sound pickup device 30 can be placed without blocking the ear canal EC. This enables measurement of the ear canal transfer characteristics in consideration of echoes in the ear canal. It is thereby possible to appropriately measure the ear canal transfer characteristics.

According to the third embodiment, the user U can wear the sound pickup device 30 by inserting the insertion part 31 into the ear canal EC. After wearing the sound pickup device 30, the user U wears the headphones 40. Then, impulse sound measurement is performed while the user U is wearing the sound pickup device 30 and the headphones 40. Specifically, the sound pickup device 30 picks up impulse sounds output from the headphones 40. It is thereby possible to appropriately measure the ear canal transfer characteristics.

Note that the microphone part 11 included in the insertion part 31 is not limited to the MEMS microphone having the substrate 11*b* as shown in FIG. 6, and it may be a single microphone. For example, the microphone part 11 may be a microphone element without having the substrate 11*b*.

Fourth Embodiment

Figure 17:
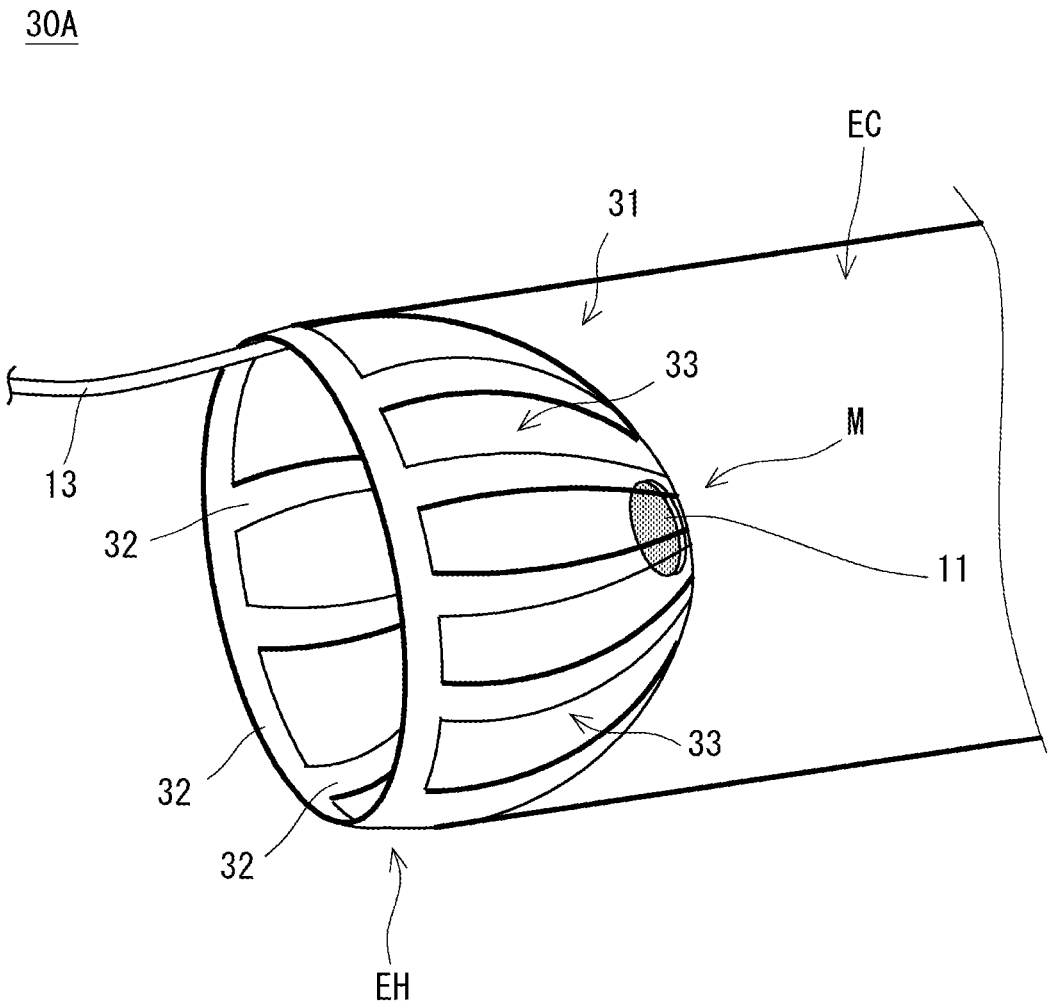
FIG. 17 is a perspective view schematically showing the structure of a sound pickup device according to a fourth embodiment.

A sound pickup device 30A according to a fourth embodiment is described hereinafter with reference to FIG. 17. FIG. 17 is an enlarged view showing the structure of the sound pickup device 30A. The sound pickup device 30A includes an insertion part 31, which is the same as in the third embodiment. It is different from the third embodiment in that the hook part 14 and the holding part 18 are not included. To be specific, the sound pickup device 30A does not include the wire 12. The description of the elements common to those in the third embodiment is omitted as appropriate.

Only the cable 13 is attached to the frame part 32. Measurement is performed in the state where the insertion part 31 is inserted into the ear canal EC, as in the third embodiment. After measurement is done, the insertion part 31 is removed from the ear canal EC by pulling the cable 13. In this embodiment, the microphone part 11 is fixed at the sound pickup position M by inserting the insertion part 31 into the ear canal EC. It is thus possible to prevent the sound pickup position M from being shifted even in the structure without the wire 12 and the holding part 18. Further, the cable 13 may be drawn to the outside of the auricle from an arbitrary position. This prevents interference with the headphones 40.

The ear canal transfer characteristics can be measured in the fourth embodiment, as in the third embodiment. It is thereby possible to appropriately measure the ear canal transfer characteristics. By pulling the cable 13 after measurement, the sound pickup device 30A is removed from the ear 50. Note that cables and cords other than the power supply cable, the signal cable and the ground cable may be attached to the frame part 32 to remove the sound pickup device 30A.

Note that the first to fourth embodiments and their modified examples may be appropriately combined. Further, the sound pickup device may be an ear-hook type where a tension is applied inward (toward the inner ear) by a spring or the like. The sound pickup device may be a headband type, not limited to an ear-hook type.

The sound pickup device according to this embodiment can fit any size of the ear. This allows closed headphones, where the effects have been less clear, to achieve out-of-head localization. This is thus effective also for the user U who has been difficult to feel the out-of-head effect.

Although embodiments of the invention made by the present invention are described in the foregoing, the present invention is not restricted to the above-described embodiments, and various changes and modifications may be made without departing from the scope of the invention.

This application is based upon and claims the benefit of priority from Japanese patent application No. 2017-26332 filed on Feb. 15, 2017, the disclosure of which is incorporated herein in its entirety by reference.

The present application is applicable to a sound pickup device that picks up sounds.

What is claimed is:

1. A sound pickup device comprising:

a microphone part placed at a sound pickup position inside an ear hole without blocking an ear canal, and positioned so as to face outside of the ear canal, the microphone part being smaller than the ear hole; and a wire having flexibility to hold the microphone in air of the ear canal and configured to extend to the sound pickup position, wherein the microphone part is placed at a leading end of the wire, and wherein at least part of the wire is formed to be deformable to be fit a shape of a front side of an auricle so that the microphone part is not in contact with an outer ear.

2. The sound pickup device according to claim 1, further comprising:

a hook part configured to hook on the auricle, wherein the wire extends from one end of the hook part to the sound pickup position, and the wire is formed along a groove of the auricle in a part of an area from the one end of the hook part to the sound pickup position.

3. The sound pickup device according to claim 2, wherein a length of the wire from the one end of the hook part to the sound pickup position is adjustable, and a direction of the wire is adjustable at the one end of the hook part.

4. The sound pickup device according to claim 1, wherein the wire includes a curved part formed along an internal surface of an internal groove shape of the auricle to fit into the internal groove shape of the auricle, and the wire is urged against the internal surface of the internal groove shape of the auricle by an urging force generated by the curved part.

5. The sound pickup device according to claim 1, further comprising:

a hook part configured to hook on the auricle, wherein the wire extends from one end of the hook part to the sound pickup position, and the wire includes a curved part formed along an internal surface of an internal groove of the auricle and fitted into the internal groove of the auricle, the curved part formed between the one end of the hook part and the sound pickup position, wherein the wire is urged against the internal surface of the internal groove by an urging force generated by the curved part.

6. A sound pickup device comprising:

a first sound pickup unit configured to be worn on a left ear of a user;

a second sound pickup unit configured to be worn on a right ear of the user; and a connection part configured to connect the first sound pickup unit and the second sound pickup unit, and generate an urging force in a direction where the first sound pickup unit and the second sound pickup unit come close to each other, wherein each of the first and second sound pickup units includes a microphone part configured to be placed at a sound pickup position inside an ear hole without blocking an ear canal, and positioned so as to face outside of the ear canal, the microphone part being smaller than the ear hole, and a wire having flexibility to hold the microphone in air of the ear canal and configured to extend to the sound pickup position, wherein at least part of the wire is formed to be deformable to fit a shape of a front side of an auricle so that the microphone part is not in contact with an outer ear, wherein the microphone part is placed at a leading end of the wire.

7. A sound pickup method comprising:

a step of outputting a measurement signal from headphones while a user is wearing the sound pickup device according to claim 1 and is wearing the headphones over the sound pickup device; and a step of picking up the measurement signal by the sound pickup device.

* * * * *